United States Patent [19]

Greenwald

[11] 4,286,132

[45] Aug. 25, 1981

[54] SNAP-ACTION SWITCH

[75] Inventor: Harry Greenwald, Whitestone, N.Y.

[73] Assignee: Greenwald Electro-Mechanical Consultants, Inc., Whitestone, N.Y.

[21] Appl. No.: 141,410

[22] Filed: Apr. 18, 1980

[51] Int. Cl.[3] ..... H01H 21/04

[52] U.S. Cl. ..... 200/67 D; 200/67 DA; 200/67 B

[58] Field of Search ..... 200/67 A, 67 B, 67 C, 200/67 D, 67 DA, 67 PK, 68, 153 LB

[56] References Cited

U.S. PATENT DOCUMENTS

| | | | |
|---|---|---|---|
| 2,700,079 | 1/1955 | Haydon | 200/67 DA |
| 2,862,083 | 11/1958 | Bailey | 200/67 B |
| 3,120,590 | 2/1964 | Dahlin | 200/67 D |
| 3,233,057 | 2/1966 | Aschwanden | 200/67 B |
| 3,485,975 | 12/1969 | Long | 200/67 B |
| 3,487,184 | 12/1969 | Arthur | 200/67 D |
| 3,497,649 | 2/1970 | Ball | 200/67 D |

*Primary Examiner*—Willis Little

*Attorney, Agent, or Firm*—McAulay, Fields, Fisher

[57] ABSTRACT

A snap-action switch is disclosed which includes a movable contact carried by an over-the-center toggle-like spring armature to snap between a first position and a second position. The armature is moved by a pushing member which, in turn, is moved by a switch activator. An energy absorbing spring member is disposed between the switch activator and the pushing member. The spring absorbs forces at least equal to the force necessary to initially move the armature in a direction from its first position to its second position. When the force necessary to move the armature becomes less than the forces absorbed by the spring, the absorbed forces are released to move the armature quickly through its deadband zone and snap the armature contact to its second position.

3 Claims, 10 Drawing Figures

SNAP-ACTION SWITCH

BACKGROUND OF THE INVENTION

1. Field of the Invention

The present invention relates to a switch and, more particularly, to a snap-action switch for use where the operation thereof is accomplished by a slowly moving activation device, such as a timing mechanism.

2. Discussion of the Prior Art

There are many applications wherein it is desirable to control the operation of a switch using a slowly moving timing mechanism. For example, interval timing devices for coin operated appliances, such as laundry machines, employ timing mechanisms which operate to activate a snap-action switch through a gear arrangement.

Unfortunately, snap-action switches have an inherent disadvantage with respect to the manner in which they are constructed when used in such application. Basically, a snap-action switch is a spring loaded toggle arm which, when moved a predetermined distance, will snap from a first position to a second position. Because the arm is spring loaded, its contact portion remains in abutment with a first stationary contact until displacement of the switch button causes the arm to move a predetermined distance to cause its contact portion to snap to the second position. However, when the button is pressed very slowly, there is a short period of time whereby the moving arm contact is no longer tightly pressed against or in pressing abutment with the first stationary contact and has not snapped over to the secondary contact. This is referred to as the deadband zone of the switch, that is, the switch is hung-up in the sense that it is in an unstable state between its first and second positions.

Typically, the activating button of the switch can be pushed slowly for between 1/1000th and 3/1000ths of an inch after pressed abutment with the first stationary contact has been broken and before the snapping action occurs. If the switch is used in a timing arrangement, and the switch contact controls the time as well as the coin operated appliance, this means that with the movement of the switch contacts apart from each other, the timing motor will stop, often before the switch has snapped to its second position. With the contacts suspended a small fraction of an inch from each other, any vibration—either physical or thermal—will cause the contacts to close briefly and perhaps spring open again in a flutter. When the contacts are pressing slightly against each other, in the sense that they are barely touching, a high resistance path for the flow of electric current is established. Current flowing through this path will generate heat which may be sufficient to destroy or burn out the contacts, or cause them to weld together. Fluttering the power source to electric motors and/or overheating of the motors, including the appliance motor and the timing motor, can cause damage to the appliance and possible injury to an unwary operator. This can also overheat the contacts to cause premature failure of the switch itself. In fact, it is not uncommon for switch manufacturers to refuse to guarantee snap-action switches when used in a timing arrangement or other slow activating arrangement.

It is therefore an object of the invention to provide a means whereby the effect of the deadband zone on the operation of the snap-action switch is substantially eliminated.

SUMMARY OF THE INVENTION

Briefly, the present invention resides in the use of a reversible force absorbing means, preferably a spring, positioned between the switching mechanism and the spring loaded armature carrying the movable contact of the switch. The reversible force absorbing means is operable to absorb the initial force applied to the armature and to subsequently release the absorbed force to displace the armature through the deadband zone to snap the armature contact to its second position without hesitation.

The preferred method of accomplishing this is with the use of a compression spring between the switch activating button and the armature abutment member. However, other means can be applied as well. For example, if the switching mechanism is in the form of a slowly rotating shaft, such as a motor shaft, a torsion spring disposed around the shaft can be used. One end of the spring is anchored to the shaft, the other end is anchored to a cam loosely or rotatably mounted on the shaft. The cam operates against the armature while the spring is wound up to reversibly absorb the switching force until sufficient force to operate the switch is generated in a manner analogous to that described for the embodiment above. A similar arrangement can be used to employ a leaf spring when the cam is fixed to the rotating shaft and operates against the leaf spring which, in turn, operates against the armature.

DESCRIPTION OF THE PREFERRED EMBODIMENT

The present invention is an improved snap-action switch for use especially in devices wherein the switch is to be activated by a slow moving switching mechanism, such as a timer device.

Figure 1:
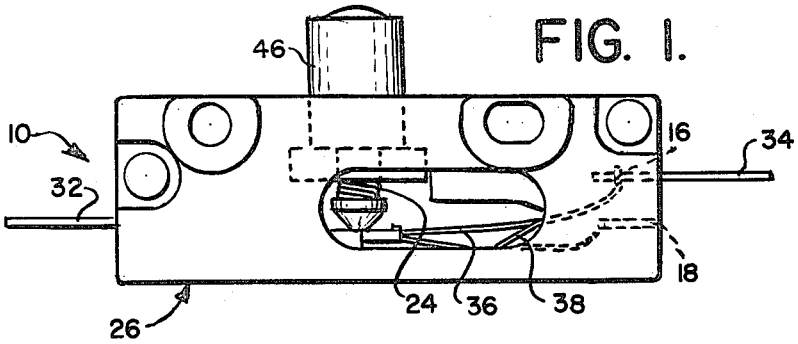
FIG. 1 is an elevational view, with side partially broken away, of a snap-action switch according to the present invention.
Figure 2:
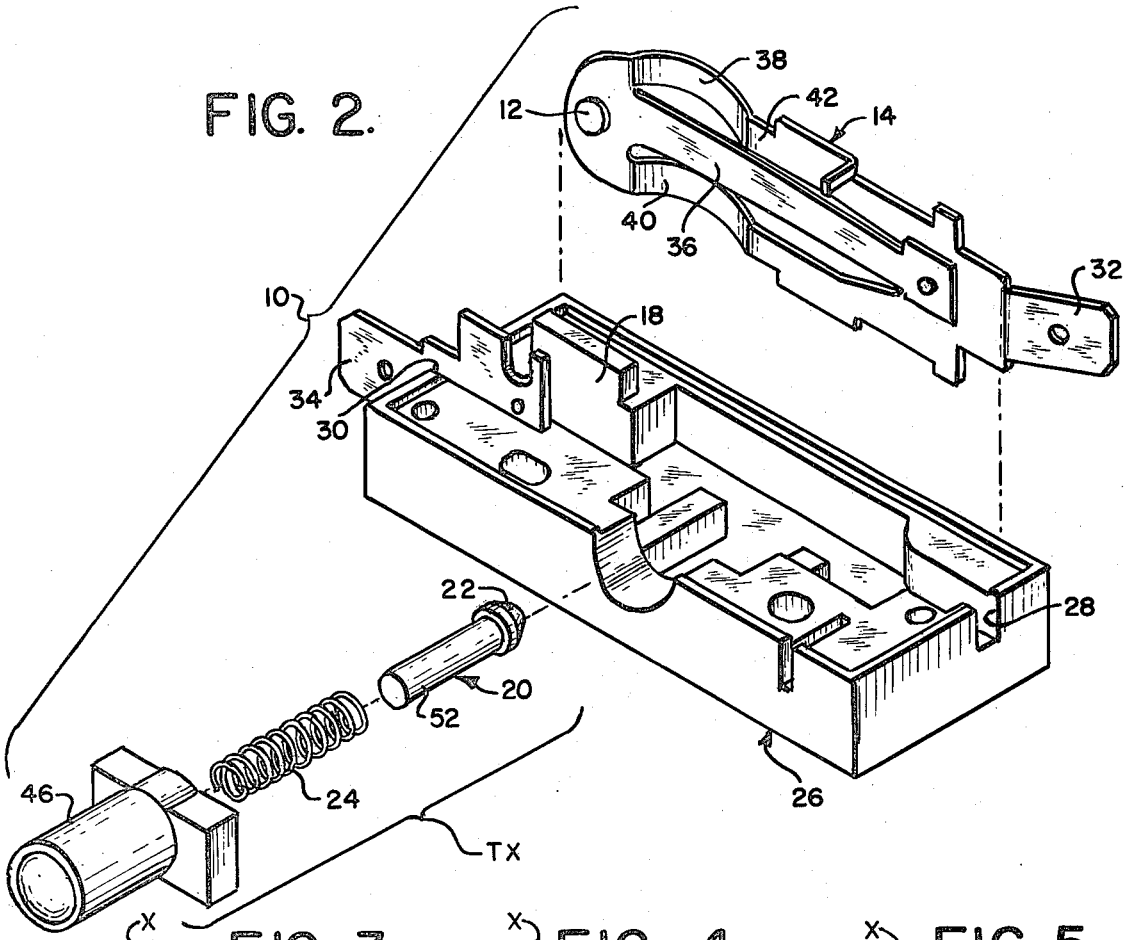
FIG. 2 is an exploded perspective view of the switch of FIG. 1.
Figure 3:
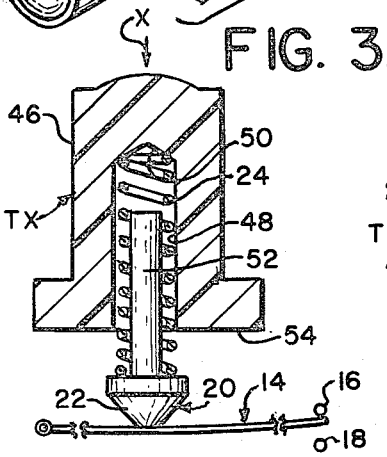
FIG. 3 is a diagrammatic sectional view showing the relationship among the various elements of a switch according to the present invention, upon initial application of the switch activating force thereto.

Basically, and with reference to FIGS. 1 and 2, the snap-action switch 10 is of the type wherein a movable contact 12, carried on an over-the-center toggle arrangement 14, is snapped between a first position wherein the movable contact 12 is in pressed abutment with a stationary contact 16, and a second position wherein the contact 12 or the end of the armature arrangement 14 on which the contact 12 is carried, is in pressed abutment with a stop or rest structure 18 under the influence of a pushing member 20. As diagrammatically illustrated in FIGS. 3–5, armature arrangement 14 is normally spring loaded to be in pressed abutment with stationary contact 16 (FIGS. 1 and 3). When sufficient force is applied against armature arrangement 14 over a sufficient distance in a direction toward stop 18, armature arrangement 14, which is in the form of an over-the-center toggle, will be displaced sufficiently for it to snap to a second position in contact with stop 18 (FIG. 5). This is accomplished by forces directed against armature arrangement 14 by the contact head 22 of pushing member 20.

An important feature of the present invention is the disposition of a reversible, force-absorbing device, preferably in the form of a spring 24 (FIGS. 1–5), between the outside switch activating mechanism generating a switching force generally designated by the letters "X" and "Y" in FIGS. 3, 4, 7, and 8, and the pushing member 20, which forms a part of the overall transmission unit represented generally by the letter "TX". As will be brought out in the discussion below, the use of a reversible, energy absorbing device, such as a spring 24, so disposed, will attenuate or substantially eliminate the effect of the deadband zone which occurs in prior art snap-action switches when such switches are activated by a slow moving switching mechanism such as a timer or the like.

The preferred embodiment includes an insulating housing 26 which may be made of bakelite or other non-conducting plastics or materials. As shown in FIG. 2, housing 26 is usually rectangular in shape, although this is not necessary for the operation of the device. Opposed ends of the housing 26 have slots 28, 30 through which electrical contact is made with the switching mechanism contained within housing 26. Armature arrangement 14 includes an electrical contact terminal 32 which extends rearwardly and projects outside of housing 26 through slot 28. Another electrical contact terminal 34 projects outside of housing 26 through slot 30, said latter terminal 34 having mounted thereon the stationary contact 16. Electrical contact to the switch 10 is by means of terminals 32 and 34.

Over-the-center toggle armature arrangement 14 comprises an armature 36 on the end of which is carried movable contact 12. Armature 36 is formed of flexible material, preferably spring metal, held under tension by a pair of leaf springs 38, 40. The preferred embodiment shown in FIG. 2 is conveniently manufactured by using a wide piece of spring metal and cutting leaf springs 38, 40 from the sides thereof, leaving the center portion to form armature 36. Leaf springs 38, 40 are then bent slightly downwardly as shown and the ends thereof secured to a support 42 to maintain them under tension.

Figure 4:
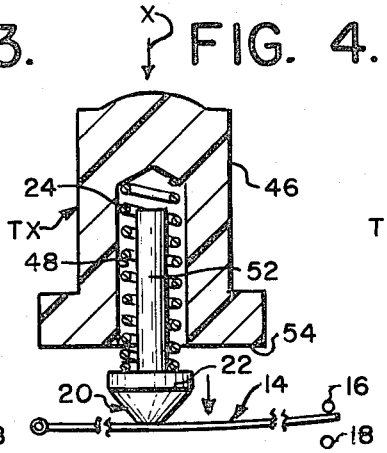
FIG. 4 is a diagrammatic view similar to FIG. 3 showing the relationship among the various elements of the switch when the switch is in its deadband position.
Figure 5:
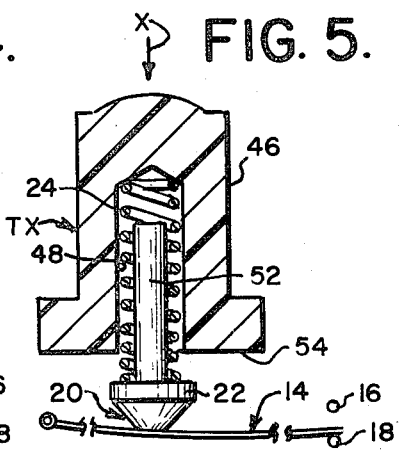
FIG. 5 is a diagrammatic view similar to FIG. 3 showing the relationship among the various elements of the switch after the switch has snapped to its second fully open position.

As discussed briefly above, when pushing member 20 applies sufficient force over a sufficient distance against armature arrangement 14, and more specifically, against a portion of armature 36, the said armature 36 will be moved past its switchover point to snap to its second position (FIGS. 3–5). As previously indicated with reference to prior art devices, when the activating force is applied very slowly, a point is reached wherein movable contact 12 is no longer in pressed abutment with stationary contact 14, but the armature 36 is not yet displaced sufficiently to cause it to switch to its second position. This is the deadband zone of the switch wherein movable contact 12 is slightly out of engagement with stationary contact 16, or is in such light contact as to make the passage of electric current therebetween occur under high resistance conditions. Not only is this objectionable with respect to the burning out of the switch contacts 12, 16, but for many applications, this can result in dangerous situations for people using equipment controlled by the switch, as well as the possible destruction of the motors in such equipment.

The present invention seeks to eliminate the effect of the deadband zone and takes advantage of the empirical determination that the initial forces required to move the armature 36 from a position wherein the stationary contact 16 and the movable contact 12 are in pressed abutment, to a position where the pressed abutment no longer occurs, are greater than the forces necessary to thereafter move the armature 36 to a position where it will be driven to its second position against stop 18.

In accordance with the teachings of the invention, a reversible energy absorbing device, such as spring 24, operable to releasably absorb the initial switching forces, is disposed between the switching force source (X, Y) and the armature 36. The release of the reversibly absorbed forces is restrained by directly transmitting them against the armature 36. The absorbed forces are released when they are at least equal to the force necessary to move armature 36 and its associated contact 12 in a direction away from its first position. This occurs preferably before the armature 36 has moved to its deadband position, at which point the force necessary to move the armature decreases sufficiently to permit the spring to release its energy. The rate at which the releasable energy absorbing device releases its energy will determine the hand-up time of the switch, that is, the length of time that armature 36 remains in its deadband position. It is contemplated that such a device will rapidly release its energy to move the armature quickly through the deadband zone to permit the armature contact to snap to its second position without the switch getting hung-up in the deadband zone. A spring 24 is ideal for such an application as it releases its energy rapidly to attenuate or substantially eliminate the effect of the deadband zone.

Figure 9:
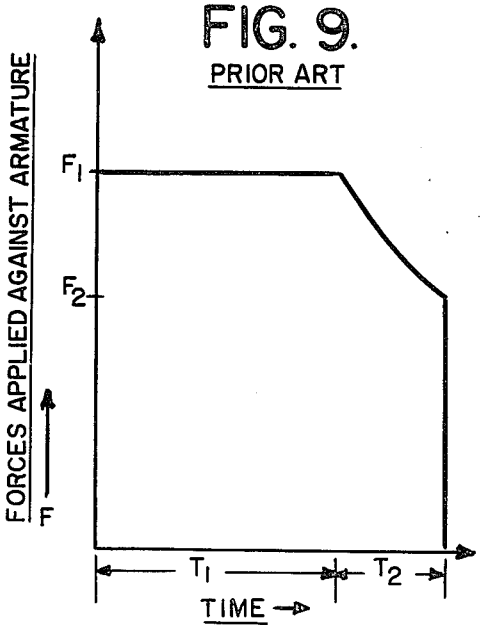
FIG. 9. PRIOR ART
FIG. 9 is a diagrammatic representation of the forces applied to the contact carrying toggle armature of a prior art switch, as the prior art switch is slowly activated by a constant speed slow moving switching mechanism.
Figure 10:
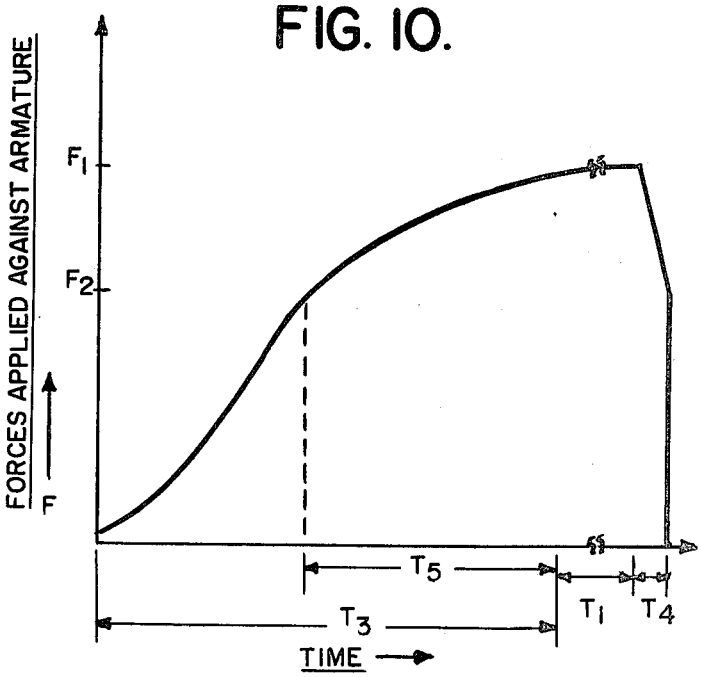
FIG. 10 is a diagrammatic representation similar to FIG. 9, for an idealized embodiment of the present invention.

FIGS. 9 and 10 are idealized comparative graphical representations of the forces applied against the armature with respect to a time base. The distances indicated on the time scales assume that a slowly moving switching mechanism operating at a constant speed is used. Thus, for the prior art device of FIG. 9 wherein there is a solid linkage between the switching mechanism and the armature, the "time" axis represents the distance through which armature 36 is flexed or moved until it snaps over to its second position. The graphical representation of FIG. 10, on the other hand, depicts the relationship between the "time" and "force" scales when the force absorbing spring member of the present invention is located between the switching mechanism and the armature, in place of a solid linkage therebetween. Various distances (or times) are marked on the "time" axis of FIG. 10 for comparison with FIG. 9.

More specifically, and with reference to FIG. 9, "$T_1$" represents the time (and therefore the distance, assuming a switching mechanism generating a constantly moving switching force) to flex armature 36 sufficiently to move the movable contact 12 from pressed abutment with stationary contact 16 to the deadband zone of the switch. "$T_2$" represents the time or distance wherein the switch is in its deadband zone, ending with the final snapping over or switching of the armature to its second position. "$F_1$" is the force applied to the armature and "$F_2$" is the reduced force applied to the armature just prior to the armature snapping to its second position.

As can be seen in FIG. 10, the switching force must be applied over a greater distance to accomplish the switching operation. This distance depends on the specific characteristics of the spring 24 or other reversible energy absorbing device used. However, the important characteristics of the spring 24 are that it absorbs sufficient energy so that it can generate enough force over the distance necessary to flex the armature to move it past its switchover position when the forces absorbed in the spring are released.

Referring to FIG. 10, the time or distance over which the applied force is absorbed by the spring is represented by "$T_3$". At that time, the force absorbed by the spring is "$F_1$". Thereafter, additional applied forces are transmitted to the armature for a time or distance "$T_1$", analogous to that of FIG. 9. However, when the armature starts to move out of its first position, that is, into its deadband zone, the force necessary to move the armature decreases. This allows the spring to uncoil, releasing its energy to propel the armature through the deadband zone in a time interval represented by "$T_4$". In other words, the armature is rapidly moved under the influence of the uncoiling spring rather than by the slow moving timing mechanism of FIG. 9. It is thus apparent that "$T_4$" is considerably less than "$T_2$" to shorten the time that the switch moves through its deadband zone. This, in turn, reduces the likelihood that the switch will be hung-up in the deadband zone.

The force released by the uncoiling spring must be of sufficient magnitude exerted over a sufficient distance to propel the armature through the deadband zone. In FIG. 9, the force necessary to move the armature through the deadband zone ranges from "$F_1$" to "$F_2$" over the distance or time "$T_2$". It therefore follows that, for the switch operation depicted in FIG. 10, the spring must absorb forces ranging from "$F_1$" to "$F_2$" over a distance "$T_5$", which distance is greater than the distance "$T_2$" of FIG. 9.

The transmission unit "TX" is shown in its operating positions in FIGS. 3, 4, and 5. The unit includes a switch button 46 formed with a spring receiving cavity 48 having a spring seat bottom 50. The spring is disposed between spring seat 50 and an enlarged back portion of contact head 22 of pushing member 20. To keep the assembly aligned, pushing member 20 has a central shaft 52 about which spring 24 is disposed. As switching forces "X" are applied to switch button 46, spring 24 compresses against the resisting forces of armature arrangement 14. As the spring compresses, the forces necessary to compress it increase until they are great enough to commence movement of armature arrangement 14 toward its switching position. In the event that the spring 24 breaks or is compressed to cause the back of contact head 22 to seat against the bottom wall 54 of the button, a rigid link between the switching forces "X" and the contact head 22 will be accomplished to transmit the switching forces "X" to the armature arrangement 14. This provides a fail-safe switching of the device.

Spring 24 is restrained in its compressed coiled condition by the resistance of armature arrangement 14. When the force necessary to move armature arrangement 14 decreases to less than that necessary to hold spring 24 in its coiled condition, as is diagrammatically shown in FIG. 4, spring 24 will uncoil. The force released by the uncoiling of spring 24 pushes armature arrangement 14 to move rapidly or snap through its deadband zone to its second position and in abutment with stop 18, as shown in FIG. 5. Thus, control of the movement of the armature through its deadband zone is not under the influence of the slowly moving timing mechanism, but rather under the force exerted by the rapidly uncoiling spring 24.

Figure 6:
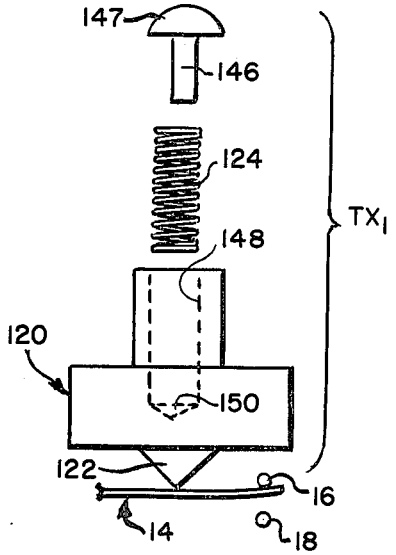
FIG. 6 is an exploded elevational view of the pushing member and spring of another embodiment of the present invention switch.

FIG. 6 illustrates another embodiment of the invention having a transmission element "$TX_1$" similar in operation to the transmission element "TX" of FIGS. 3, 4, and 5. However, the location of the coil spring 124 is somewhat different, as is the structure of the transmission element. As can be seen in FIG. 6, pushing member 120 is the element wherein the spring receiving cavity 148 is disposed. Switch button 146 has an enlarged head 147 which acts against spring 124. The other end of spring 124 is seated in spring seat 150. As with the embodiment discussed above, a contact head 122 is disposed on the lower end of pushing member 120 for moving armature arrangement 14 between its first and second positions.

Figure 7:
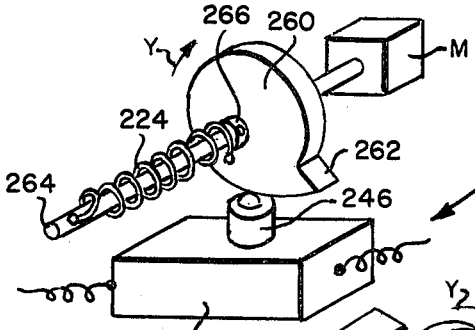
FIG. 7 is a diagrammatic perspective view of a further embodiment of the present invention for use with rotary switch activating forces.
Figure 8:
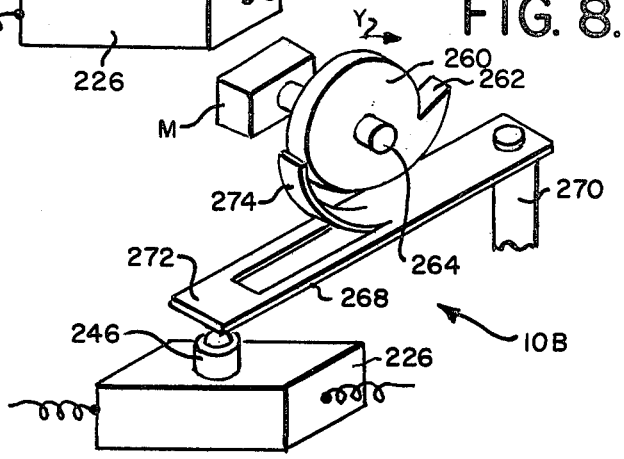
FIG. 8 is a diagrammatic perspective view of another embodiment of the present invention for use with rotary switch activating forces.

FIGS. 7 and 8 illustrate modified embodiments of the invention wherein switches 10A and 10B are activated by rotating switching mechanisms. In both the embodiments, the portions of the switches within housing 226 may have the standard snap-action switch construction of the prior art. The switches 10A and 10B further include a cam member 260 having a step portion 262. The switching mechanism consists of a rotating shaft 264 driven by a timing motor or other mechanism "M".

In the embodiment of FIG. 7, the reversible energy absorbing means is in the form of a torsion spring 224. Cam 260 is rotatably mounted on shaft 264 and is operatively secured thereto by torsion spring 224. One end of the spring is secured to cam 260 and the other end is anchored to shaft 264. A collar 266, or other similar means, is secured to shaft 264 to restrain axial movement of the cam along the shaft in the direction of the spring.

In operation, shaft 264 is rotated in the direction represented by the arrow "Y" until cam step 262 engages switch button 246. As shaft 264 continues to rotate, cam 260 is prevented from displacing button 246 inwardly by the restraining spring force of armature arrangement 14. This causes spring 224 to wind up and absorb the switching forces until the force transmitted to cam 260 exceeds the resistance of armature arrangement 14. Continued rotation of shaft 264 now causes cam 260 to rotate therewith causing inward displacement of button 246 with resulting movement of armature arrangement 14. When the armature 14 reaches its deadband zone, torsion spring 224 unwinds driving armature arrangement 14 through its deadband zone to rapidly switch to its second position.

The embodiment of FIG. 8 operates much like the embodiment of FIG. 7 except that cam 260 is fixedly connected to shaft 264 to rotate directly therewith. A spring body 268 is mounted at one end to a support structure 270. The other free end 272 is positioned to rest in contact with button 246. Intermediate the ends of body 268 is an upwardly extending portion 274 which is struck or stamped out of body 268, and which functions as a leaf spring.

In operation, when cam step 262 engages leaf spring 274, it generates a downward force against spring body 268 which, in turn, causes the free end 272 to press against switch button 246. Movement of switch button 246 is prevented by the restraining spring force of armature arrangement 14. When the forces stored in leaf spring 274 are sufficient to overcome the resistance of armature arrangement 14, the forces will be released, driving armature arrangement 14 through its deadband zone to rapidly switch to its second position.

While preferred embodiments of the invention have been shown and described in detail, it will be readily understood and appreciated that numerous omissions, changes, and additions may be made without departing from the spirit and scope of the present invention.

What is claimed is:

1. A snap-action switch for activation by a slow moving switching mechanism comprising:

a single over-the-center toggle-like spring armature disposed to snap between a first position and a second position, said armature carrying a movable contact, said armature resisting movement until moved past its deadband zone whereafter said armature snaps from said first position to said second position;

a pushing member positioned to move said armature off said first position;

a switch activator adapted to be moved by said slow moving switching mechanism;

spring means resiliently coupled between said switch activator and said pushing member, said spring means transmitting force from said switch activator to said pushing member and absorbing energy as said switch activator is moved; the resilient force exerted by said spring means at the point where said armature starts to move through said deadband zone equalling the resistive force of said armature;

said armature when moving through said deadband zone reducing its resistive force at a rate causing said resistive force to be less than said resilient force of said spring means, the unbalanced resilient force causing said armature to rapidly move through said deadband zone and snap said armature to its second position.

2. The snap-action switch of claim 1 wherein said pushing member comprises an elongated rod terminating in an enlarged head, and said switch activator comprises a push button formed having a cavity therein; said spring means comprising a coil compression spring sized to receive said rod and abut against said head; and said button cavity being sized to receive a portion of said rod with said spring disposed thereabout and with said head portion projecting outwardly thereof under the influence of said spring for engagement with said armature.

3. The snap-action switch of claim 1 wherein said switch activator comprises an elongated rod terminating in an elongated head, and said pushing member comprises a push button formed having a cavity therein; said spring means comprising a coil compression spring sized to receive said rod and abut against said head; said button cavity being sized to receive a portion of said rod with said spring disposed thereabout and with said head portion projecting outwardly thereof under the influence of said spring; and said button further including a contact head for engagement with said armature.

* * * * *